US011089872B1

(12) United States Patent
Chen

(10) Patent No.: US 11,089,872 B1
(45) Date of Patent: Aug. 17, 2021

(54) INTERLOCKING SLIDE RAIL SET COMBINED WITH FRONT CABINET LOCK

(71) Applicant: MARTAS PRECISION SLIDE CO., LTD., New Taipei (TW)

(72) Inventor: Wan-Lai Chen, New Taipei (TW)

(73) Assignee: MARTAS PRECISION SLIDE CO., LTD., New Taipei (TW)

( * ) Notice: Subject to any disclaimer, the term of this patent is extended or adjusted under 35 U.S.C. 154(b) by 0 days.

(21) Appl. No.: 17/033,690

(22) Filed: Sep. 26, 2020

(51) Int. Cl.
*A47B 88/57* (2017.01)
*A47B 88/49* (2017.01)

(52) U.S. Cl.
CPC ..... *A47B 88/57* (2017.01); *A47B 88/49* (2017.01); *A47B 2210/0016* (2013.01); *A47B 2210/0059* (2013.01)

(58) Field of Classification Search
CPC ..... A47B 88/49; A47B 88/57
USPC ..... 312/333, 216, 217, 219, 221
See application file for complete search history.

(56) References Cited

U.S. PATENT DOCUMENTS 4,865,404 A * 9/1989 Harper ..... E05B 65/463 312/221
4,957,334 A * 9/1990 Lakso ..... E05B 65/464 312/219
5,199,774 A * 4/1993 Hedinger ..... E05B 65/466 312/219
6,296,332 B1 * 10/2001 Lammens ..... E05B 65/464 312/217
6,450,596 B1 * 9/2002 Lee ..... E05B 65/464 312/217
8,371,664 B1 * 2/2013 Chen ..... A47B 88/43 312/221
8,696,074 B2 * 4/2014 Romaen ..... E05B 65/462 312/221
2006/0267461 A1 * 11/2006 Hoffman ..... E05B 65/466 312/219
2008/0106175 A1 * 5/2008 Huang ..... E05B 65/464 312/217
2008/0203862 A1 * 8/2008 Sevillano Gil ..... E05B 65/464 312/216

FOREIGN PATENT DOCUMENTS

TW M244802 10/2004
TW M245274 10/2004
(Continued)

*Primary Examiner* — James O Hansen
(74) *Attorney, Agent, or Firm* — Fei-hung Yang

(57) ABSTRACT

An interlocking slide rail set combined with a front cabinet lock includes the cabinet lock and plural interlocking slide rails. The cabinet lock is installed to a cabinet having plural drawers, and a rear end of the cabinet lock is connected to a driving portion. Each interlocking slide rail has an inner rail, a middle rail, an outer rail, plural slide assisting elements, a stopper, a pair of interlocking sliders and an interlocking rod, and the stopper is installed at a front end of the outer rail, and the two interlocking sliders are installed to the outer rails respectively, and two adjacent interlocking slide rail mechanisms are connected by the interlocking rod. During operation of using the cabinet lock or pulling any drawers, the interlocking sliders and the interlocking rods are linked to achieve an interlocking effect, thus simplifying or reducing components, facilitating installation, and lowering manufacturing costs.

7 Claims, 7 Drawing Sheets

(56) References Cited

FOREIGN PATENT DOCUMENTS

| | | |
|---|---|---|
| TW | M284291 | 1/2006 |
| TW | M333109 | 6/2008 |
| TW | I428102 | 3/2014 |
| TW | I455700 | 10/2014 |

* cited by examiner

INTERLOCKING SLIDE RAIL SET COMBINED WITH FRONT CABINET LOCK

BACKGROUND

Technical Field

The present disclosure relates to the field of a slide rail structure. More particularly, the present disclosure relates to an interlocking slide rail set combined with a front cabinet lock, wherein an inner rail and a middle rail are used and operated with the linkage of an interlocking slider and an interlocking rod to achieve an interlock effect when a cabinet lock is used or a drawer is drawn, so as to achieve the effects of simplifying and reducing structural components, facilitating installation, and lowering manufacturing costs.

Description of Related Art

The slide rail structure is mainly used to carry an object for linear sliding and installation, and the slide rail structure generally includes a fixed rail, at least one slide rail and at least one sliding part, and the object can use a ball as the sliding part to slide the sliding rail with respect to the fixed rail. Although this structure can improve the smoothness of pulling a drawer, yet the drawer often slides out on its own or several drawers are opened simultaneously, thus causing a deviation of the center of gravity of the cabinet and incurring a potential danger of crushing or pinching.

In order to prevent the occurrence of the aforementioned situations, a variety of slide rail mechanisms with an interlock effect have been introduced to the market and these interlocking structures include R.O.C. Pat. Nos. M333109 entitled "Front interlocking structure of drawer slide rail", M244802 entitled "Drawer interlocking and latching device", M245274 entitled "Improved drawer interlocking and latching device", M284291 entitled "Drawer interlocking, braking, and latching device", I455700 entitled "Drawer slide rail linking and interlocking device", and I428102 entitled "Linking and interlocking structure of drawer slide rail", which have disclosed various different interlocking structures or devices and used different linking and interlocking methods to prevent drawers without any limiting function from opening, and the interlocking mechanisms or devices generally use a pair of interlocking sliders fixed onto the slide rail to link and prop a driving part or a rotary switch after the slide rail has been pulled out, so that the interlocking structures or devices on the slide rails of other unused drawers are squeezed and locked.

At present, it is necessary to install the interlocking sliders movably by means of a holder in order to use the interlocking structures or devices, and the holder must have the driving part or rotary switch which is configured to be corresponsive to the slide rail, such that after the slide rail is triggered and driven, the interlocking structures or devices will be linked to prop the interlocking sliders, and a plurality of link rods connected between the interlocking structures or devices can be used to achieve the linking and locking effects. The conventional structures of the interlocking structures or devices are complicated and inconvenient for assemblers, thus causing an increase of development and manufacturing costs. Obviously, the conventional structures or devices require improvements.

SUMMARY

In view of the drawbacks of the aforementioned conventional interlocking structures or devices, it is a primary objective of the present disclosure to provide an interlocking slide rail set combined with a front cabinet lock, wherein an inner rail and a middle rail are operated together with the linkage of a pair of interlocking sliders and a plurality of interlocking rods to achieve an interlocking effect during an operation such as using a cabinet lock or pulling out a drawer, so as to achieve the effects of simplifying or reducing components, facilitating installation, and lowering manufacturing costs.

To achieve the aforementioned and other objectives, the present disclosure discloses an interlocking slide rail set combined with a front cabinet lock, installed to a cabinet, wherein the cabinet has a plurality of drawers and a keyhole formed at a front side of the cabinet, and the interlocking slide rail set comprises: the cabinet lock, installed into the keyhole at the front side of the cabinet, and having a key disposed at a front side of the cabinet lock, and a driving portion coupled to the key; and an interlocking slide rail set, installed between each of the drawers and the cabinet, and each of the interlocking slide rails comprising an inner rail, a middle rail, an outer rail, a plurality of slide assisting elements, a stopper, a pair of interlocking sliders and a plurality of interlocking rods, wherein the inner rail, the a slide assisting element, and the middle rail and the other slide assisting elements being sequentially and movably installed into the outer rail, and the stopper being installed at the front end of the outer rail, and both side edges of the front end of the outer rail having a limiting hole for installing the two interlocking sliders therein, and the stopper having a stopping portion extending towards the interior of the outer rail to block the two interlocking sliders at a set position to define a suppression, so that the two interlocking sliders are configured to be opposite to each other and maintained in a free gravity state at the set position, and the adjacent interlocking mechanisms being coupled to each other by an interlocking rod. Therefore, when any one of the drawers is pulled out, the inner rail, the middle rail and the two slide assisting elements are linked and pulled out sequentially, and when the inner rail passes through the two interlocking sliders, the inner rail can prop the two interlocking sliders for a first time, and then when the middle rail passes through the two interlocking sliders, the middle rail can prop the two interlocking sliders for a second time, and the interlocking rods are used to restrict movement with respect to each other, so that the other interlocking slide rails are locked to achieve an interlocking effect.

In an embodiment of the present disclosure, each of the interlocking sliders has an actuating portion configured to be corresponsive to the inner rail and the middle rail, and the inner rail has a first guiding portion at a front end thereof, and the middle rail has a second guiding portion at a front end thereof. In addition, the first guiding portion is formed by bending both side edges of the inner rail obliquely and inwardly, and the second guiding portion is formed by bending both side edges of the middle rail obliquely and inwardly. Each of the interlocking sliders has a mounting portion configured to be corresponsive to the interlocking rod, and the mounting portion comprises a retaining wall, a pair of hooks and a positioning slot, and the retaining wall is configured to be corresponsive to an end of the interlocking rod, and the pair of hooks are disposed on both sides of the retaining wall respectively, and the positioning slot is disposed on the other side of the retaining wall. During installation, an end of the interlocking rod is abutted against the retaining wall, and then the interlocking rod is squeezed between the pair of hooks, so that the interlocking rod is latched among the retaining wall, the pair of hooks and the positioning slot. The retaining wall has a guiding block formed thereon and configured to be corresponsive to an end of the interlocking rod. A sliding slot is formed between the retaining wall and the actuating portion and configured to be corresponsive to the limiting hole for movably passing into the limiting hole.

In another embodiment of the present disclosure, both side edges of the inner rail have a pair of engaging slots configured to be corresponsive to a rear side of the first guiding portion for latching and positioning the second guiding portion of the middle rail, so that the middle rail will be pulled outwardly with the inner rail. In addition, the stopping portion has a limiting slot formed on a side relative to the two interlocking sliders, and the two interlocking sliders have a limiting boss corresponding to each other, so that after the stopper is installed, the two limiting bosses are pressed into the limiting slot to maintain a limit sliding state, so as to simplify the assembling process and improve the accuracy and efficiency of the installation significantly.

In addition, the interlocking slide rail set combined with a front cabinet lock of the present disclosure further comprises a link rod sleeve and a link rod holder, and the link rod sleeve being installed to an end of the uppermost interlocking rod, and the link rod holder being installed into the cabinet and adjacent to the cabinet lock, so that the link rod sleeve is movably wrapped into the link rod holder, and the top of the link rod sleeve is configured to be corresponsive to the driving portion, and after the cabinet lock is turned, the driving portion presses the link rod sleeve to lock the interlocking slide rails.

DESCRIPTION OF THE EMBODIMENTS

Figure 1:
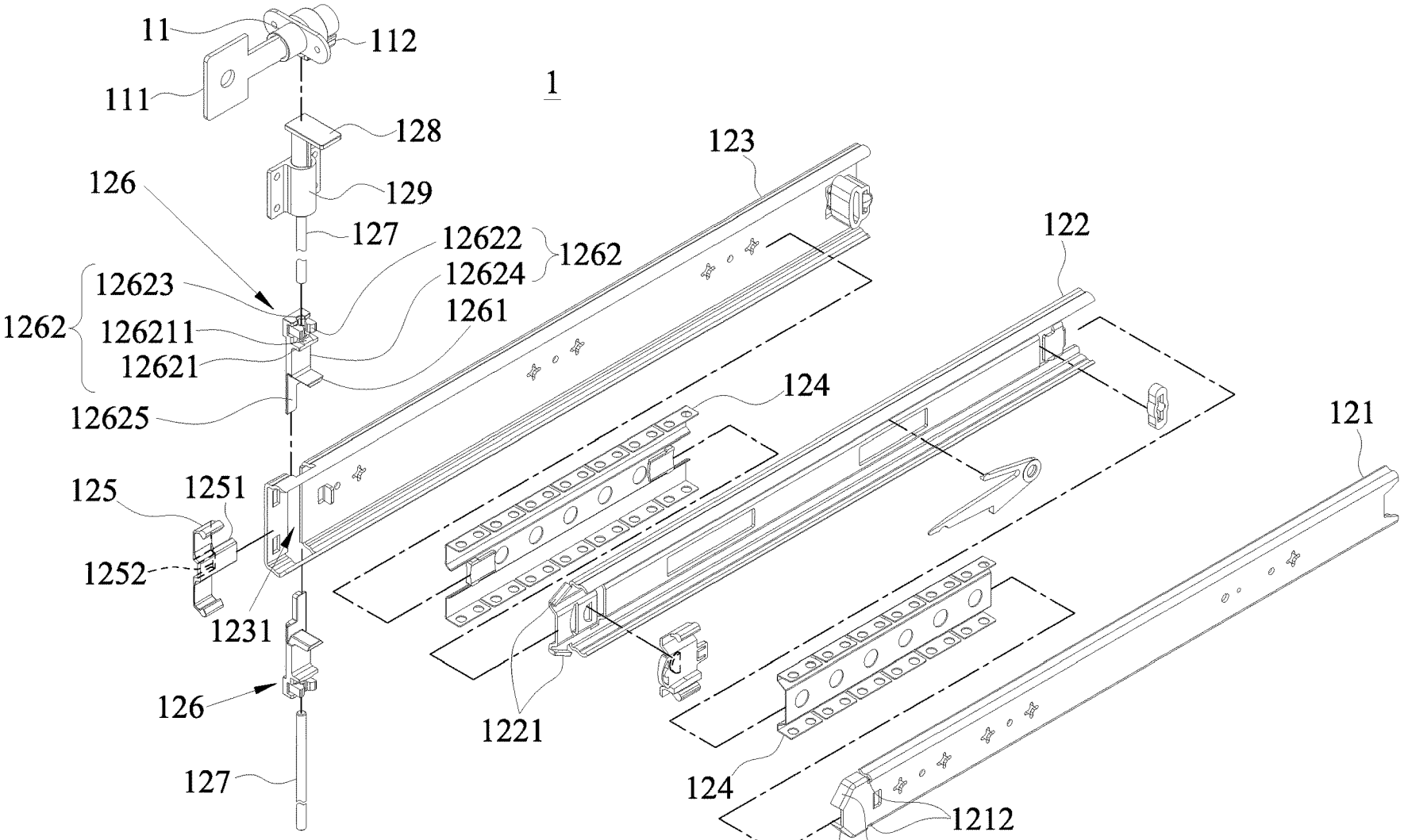
FIG. 1 is an exploded view of a preferred embodiment of this disclosure.
Figure 2:
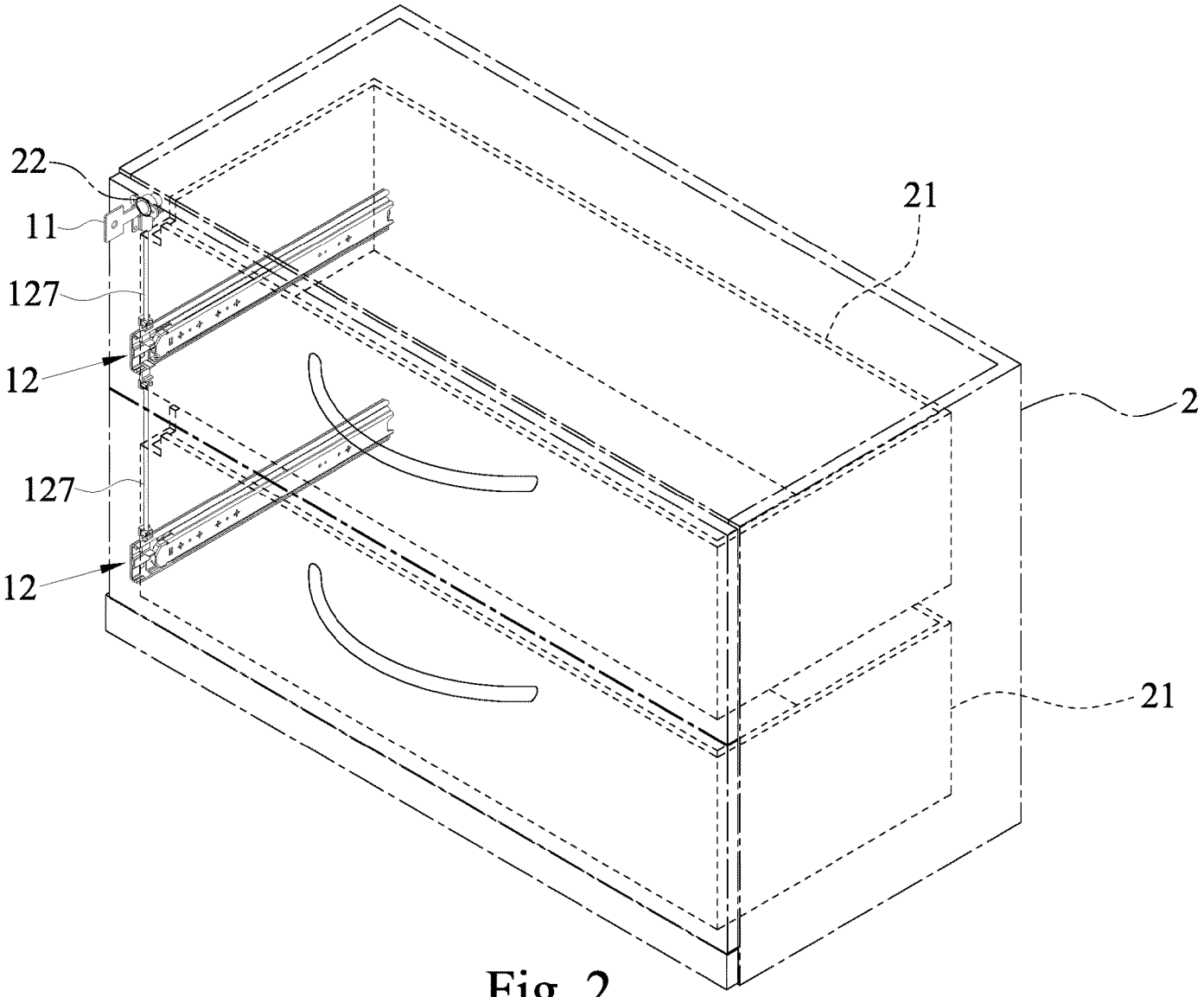
FIG. 2 is a perspective view of a preferred embodiment of the present disclosure.
Figure 3:
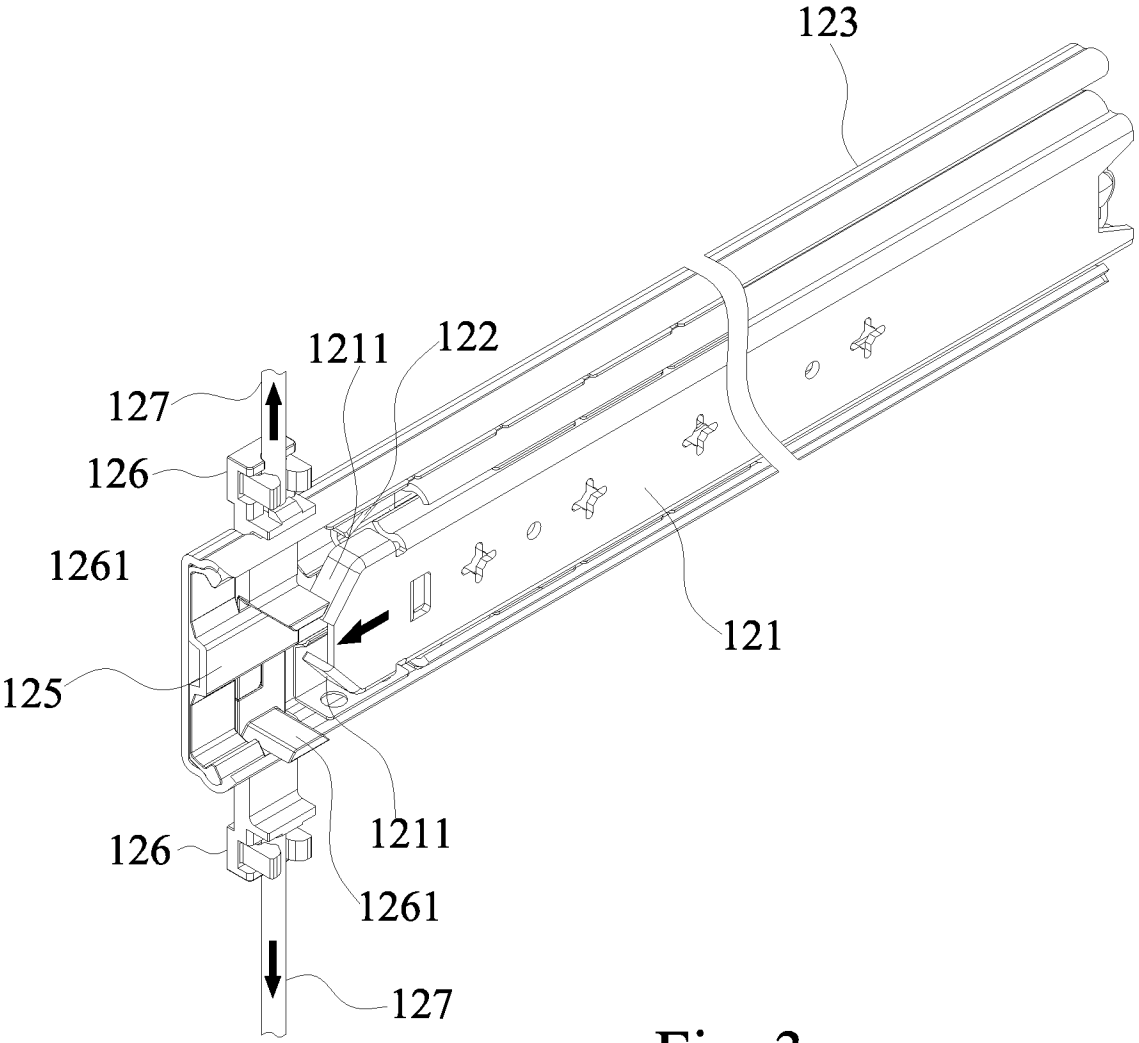
FIG. 3 is a first schematic view showing a using status in accordance with a preferred embodiment of the present disclosure.
Figure 4:
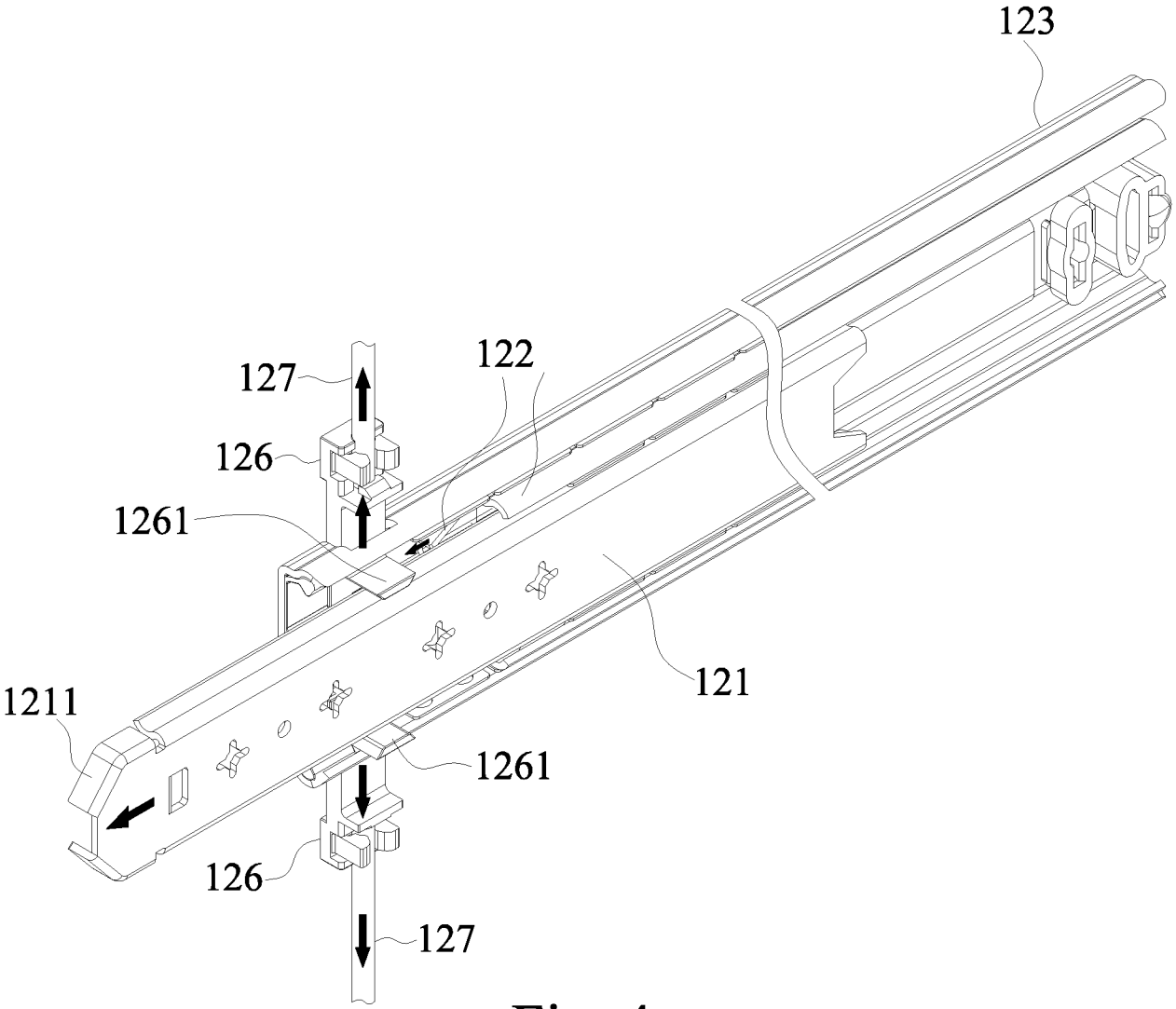
FIG. 4 is a second schematic view showing a using status in accordance with a preferred embodiment of the present disclosure.
Figure 5:
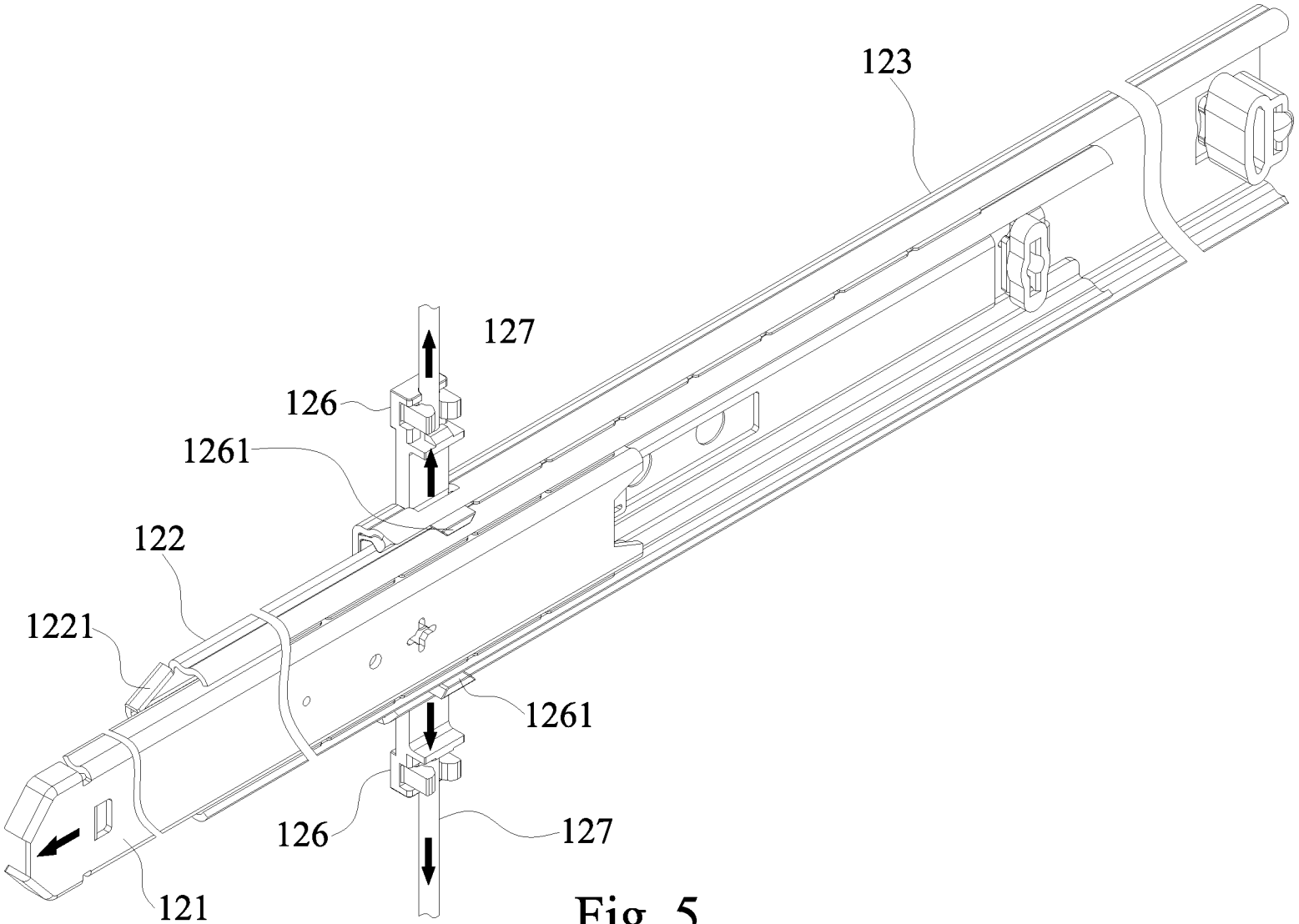
FIG. 5 is a third schematic view showing a using status in accordance with a preferred embodiment of the present disclosure.
Figure 6:
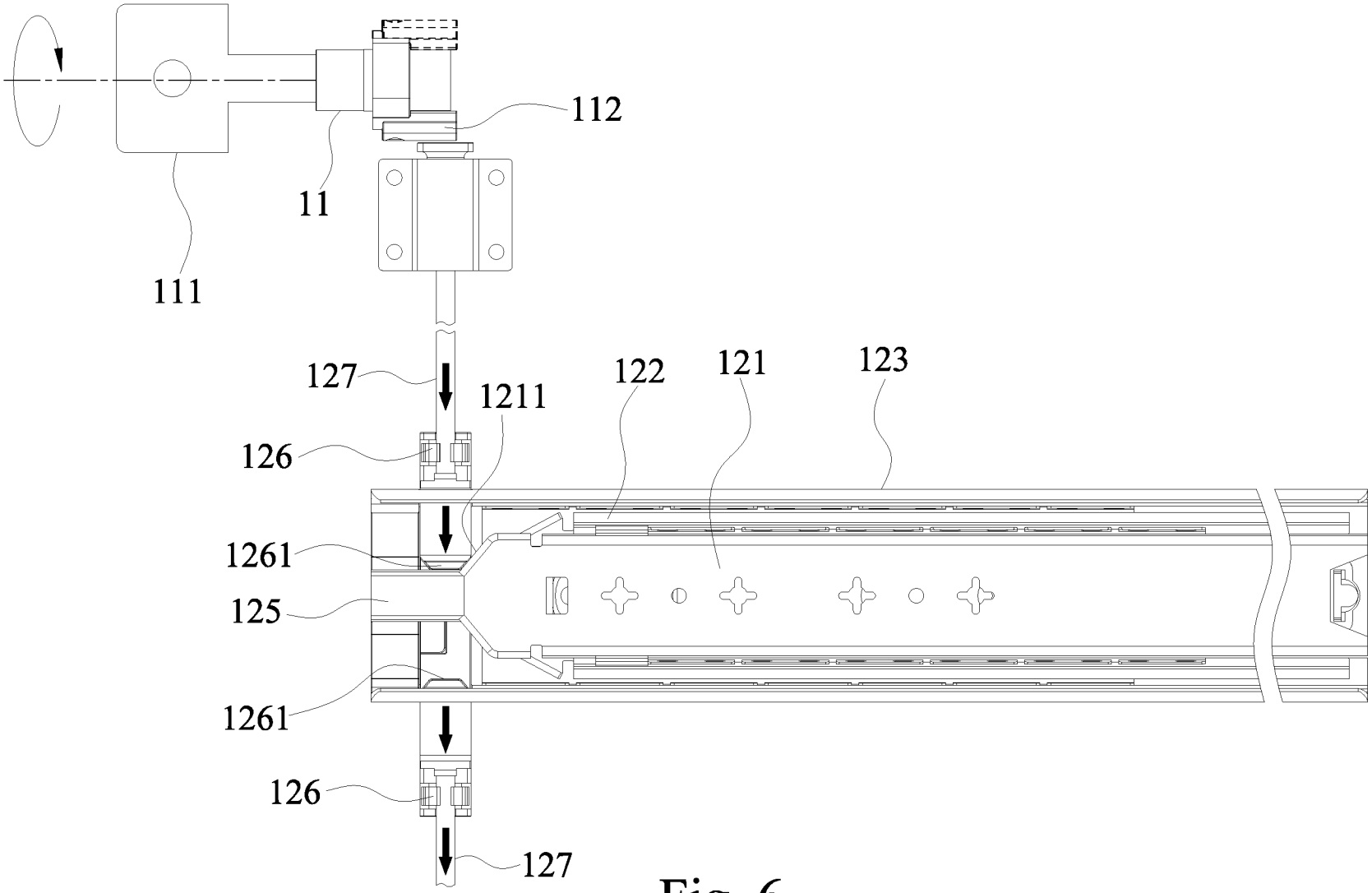
FIG. 6 is a schematic view showing a status of using a cabinet lock for locking in accordance with a preferred embodiment of the present disclosure.

The accompanying drawings are included to provide a further understanding of the disclosure, and are incorporated in and constitute a part of this specification. The drawings illustrate embodiments of the disclosure and, together with the description, serve to explain the principles of the disclosure.

With reference to FIGS. 1, 2, 3 to 5, and 6 for the exploded view and the perspective view of an interlocking slide rail set combined with a front cabinet lock, the schematic views showing various different using statuses of the interlocking slide rail set, and the schematic view showing a status of using a cabinet lock for locking in accordance with a preferred embodiment of the present disclosure respectively, the interlocking slide rail set combined with a front cabinet lock 1 is installed on a cabinet 2, wherein the cabinet 2 has a plurality of drawers 21, and a keyhole 22 is formed at a front side of the cabinet 2, and the interlocking slide rail set combined with a front cabinet lock 1 comprises the cabinet lock 11 and a plurality of interlocking slide rails 12.

Wherein, the cabinet lock 11 is installed in the keyhole 22 at a front side of the cabinet 2, and the cabinet lock 2 has a key 111 installed to a front side of the cabinet lock 11, and a driving portion 112 coupled to the key 111, as shown in the figures, wherein the driving portion 112 is an adapter type driving portion corresponding to the cabinet lock 11, so that different types of driving portions 112 can be used for different types of cabinet locks 11. It is noteworthy that the present disclosure adopts a rotary driving portion 112.

Each of the interlocking slide rails 12 is installed between each of the drawers 21 and the cabinet 2, and each interlocking slide rail 12 comprises an inner rail 121, a middle rail 122, an outer rail 123, a plurality of slide assisting elements 124, a stopper 125, a pair of interlocking sliders 126 and an interlocking rod 127, and the inner rail 121, one of the slide assisting elements 124, the middle rail 122 and the other one of the slide assisting elements 124 are sequentially and movably installed in the outer rail 123, and the stopper 125 is installed at a front end of the outer rail 123, and a limiting hole 1231 is separately formed on both side edges at the front end of the outer rail 123 and movably installed into the two interlocking sliders 126. In addition, the stopper 125 has a stopping portion 1251 extending into the outer rail 123 to block the two interlocking sliders 126 at a set position to define a suppression, so that the two interlocking sliders 126 are configured to be opposite to each other and maintained in a free gravity state at the set position, and the two interlocking sliders 126 can be prevented from being loosened or separated during use, and two adjacent interlocking slide rails 12 are coupled to each other by an interlocking rod 127.

It is noteworthy that each of the interlocking sliders 126 has an actuating portion 1261 configured to be corresponsive to the inner rail 121 and the middle rail 122, and the inner rail 121 has a first guiding portion 1211 at a front end of the inner rail 121, and the middle rail 122 has a second guiding portion 1221 at a front end of the middle rail 122, and the first guiding portion 1211 is formed by bending both side edges of the front end of the inner rail 121 obliquely and inwardly, and the second guiding portion 1221 is formed by bending both side edges of the front end of the middle rail 122 obliquely and inwardly.

In addition, each of the interlocking sliders 126 has a mounting portion 1262 configured to be corresponsive to the interlocking rod 127, and the mounting portion 1262 comprises a retaining wall 12621, a pair of hooks 12622 and a positioning slot 12623, and the retaining wall 12621 is installed at an end of the interlocking rod 127, and the pair of hooks 12622 are disposed on both sides of the retaining wall 12621 respectively, and the positioning slot 12623 is disposed on the other side of the retaining wall 12621. During installation, an end of the interlocking rod 127 is abutted against the retaining wall 12621, and the interlocking rod 127 is squeezed between the pair of hooks 12622, so that the interlocking rod 127 is latched among the retaining wall 12621, the pair of hooks 12622 and the positioning slot 12623. Further, the retaining wall 12621 has a guiding block 126211 configured to be corresponsive to an end of the interlocking rod 127, and a sliding slot 12624 is formed between the retaining wall 12621 and the actuating portion 1261 and configured to be corresponsive to the limiting hole 1231 for movably passing into the limiting hole 1231. In addition, a pair of engaging slots 1212 are formed on both side edges of the inner rail 121 respectively and configured to be corresponsive to the rear of the first guiding portion 1211 for latching and positioning the second guiding portion 12 of the middle rail 122. The stopping portion 1251 has a limiting slot 1252 formed on a side opposite to the two interlocking sliders 126, and a limiting boss 12625 formed on the two interlocking sliders 126 separately, and the two limiting bosses 12625 are configured to be corresponsive to each other, so that after the stopper 125 is installed, the two limiting bosses 12625 are pressed into the limiting slot 1252 to maintain a limit sliding state.

Figure 7:
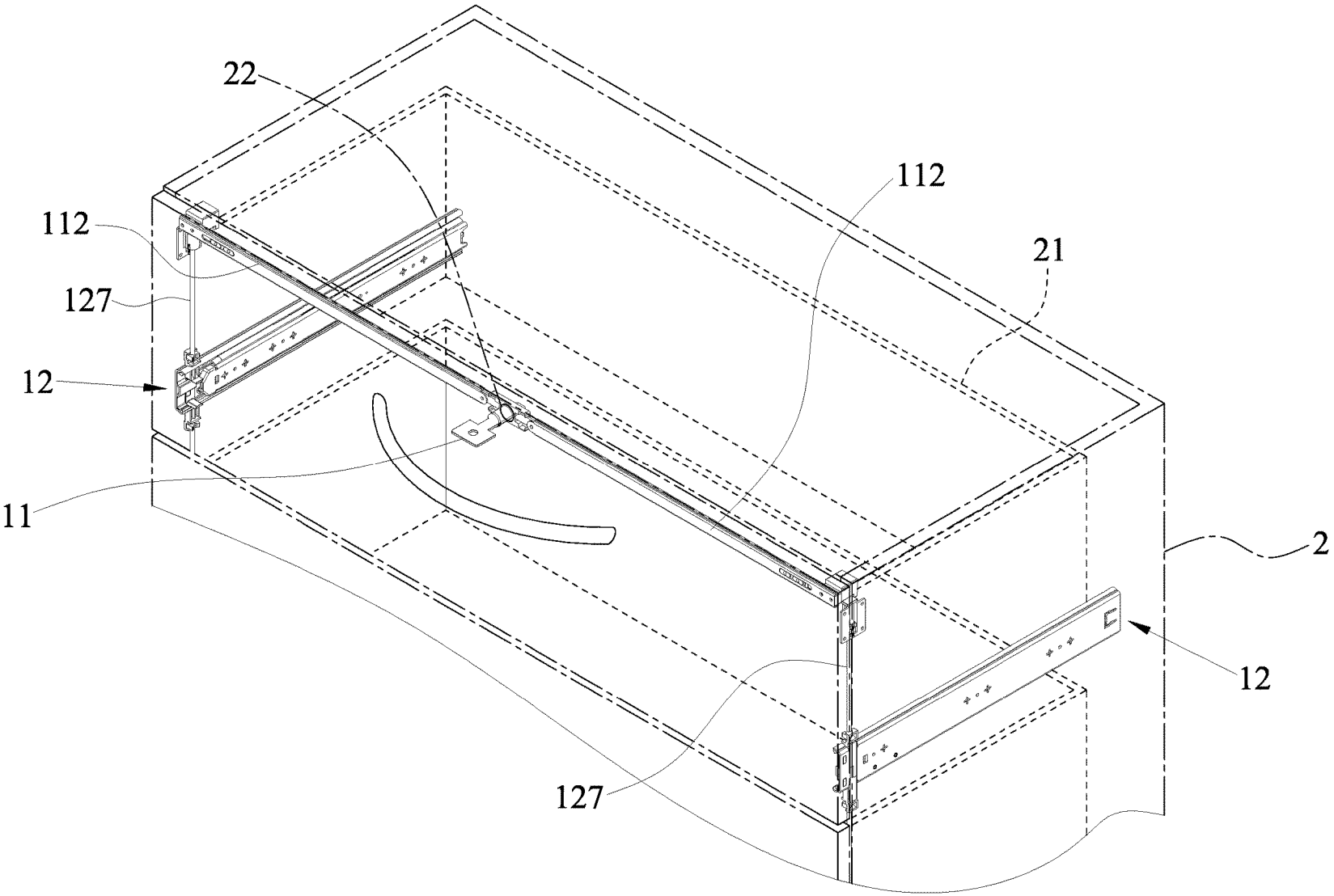
FIG. 7 is a schematic view showing another preferred embodiment of this disclosure.

The interlocking slide rail set combined with a front cabinet lock 1 in accordance with the present disclosure further comprises a link rod sleeve 128 and a link rod holder 129, and the link rod sleeve 128 is installed at an end of the uppermost interlocking rod 127, and the link rod holder 129 is installed inside the cabinet 2 and at a position adjacent to the cabinet lock 11, so that the link rod sleeve 128 is movably wrapped into the link rod holder 129, and the top of the link rod sleeve 128 is configured to be corresponsive to the driving portion 112. After the cabinet lock 11 is turned, the driving portion 112 is rotated to press the link rod sleeve 128, and the interlocking slide rails 12 are locked. Please also refer to FIG. 7, which is a schematic view showing another preferred embodiment of this disclosure. The cabinet lock 11 is set in the center of the cabinet 2 and the drive portion 112 is respectively provided on both sides of the cabinet lock 11, As shown in the figure, each the driving portion 112 is set as a rod. After the cabinet lock 11 is rotated, the ends of the two driving portions 112 move toward the outer sides of the cabinet 2 and abut against the top of the two interlocking rods 12, and it can also lock the interlocking slide rails 12.

Therefore, when any one of the drawers 21 is pulled, the inner rail 121, the middle rail 122 and the two slide assisting elements 124 are linked and pulled out sequentially, and when the inner rail 121 passes through the two interlocking sliders 126, the inner rail 121 can prop the two interlock sliders 126 out for a first time, and then when the middle rail 122 passes through the two interlocking sliders 126, the middle rail 122 can prop the two interlocking sliders 126 out for a second time. Since the two interlocking sliders 126 are propped outwardly to link and move the interlocking rods 127 in a direction towards the drawers 21 and the interlocking rods 127 and the interlocking sliders 126 are used to restrict movements with respect to each other, so that the other interlocking slide rails 12 are locked to achieve an interlocking effect. Furthermore, in the operation of the cabinet lock 11, the driving portion 112 can be rotated to push the link rod sleeve 128, so as to link the interlocking rods 127 to move in a direction towards the adjacent drawers 21, and the interlocking rods 127 and the interlocking sliders 126 will restrict movements with respect to each other and lock the other interlocking slide rails 12 to achieve the same interlocking effect, and the effects of lowering manufacturing costs, and facilitating installation.

What is claimed is:

1. An interlocking slide rail set combined with a front cabinet lock, installed to a cabinet, and the cabinet having a plurality of drawers, and a keyhole formed at a front side of the cabinet, comprising:

the cabinet lock, installed into the keyhole at the front side of the cabinet, and having a key disposed at a front side of the cabinet lock, and a driving portion coupled to the key; and a plurality of interlocking slide rails, installed between each of the drawers and the cabinet, and each of the interlocking slide rails comprising an inner rail, a middle rail, an outer rail, a plurality of slide assisting elements, a stopper, a pair of interlocking sliders and a plurality of interlocking rods, and the inner rail, the slide assisting element, and the middle rail and the other slide assisting elements being sequentially and movably installed into the outer rail, and the stopper being installed at the front end of the outer rail, and both side edges of the front end of the outer rail having a limiting hole provided for movably installing the two interlocking sliders therein, and the stopper having a stopping portion extending towards the interior of the outer rail to block the two interlocking sliders at a set position to define a suppression, so that the two interlocking sliders are configured to be opposite to each other and maintained in a free gravity state at the set position, and the interlocking slide rails arranged adjacent to each other are coupled by an interlocking rod;

thereby, when any one of the drawers is pulled out, the inner rail, the middle rail and the two slide assisting elements are linked to be pulled out sequentially, and when the inner rail passes through the two interlocking sliders, the inner rail can prop the two interlocking sliders for a first time, and then when the middle rail passes through the two interlocking sliders, the middle rail can prop the two interlocking sliders for a second time, and the interlocking rods are used to restrict movements with respect to each other, so that the other interlocking slide rails are locked to achieve an interlocking effect;

wherein each of the interlocking sliders has a mounting portion configured to be corresponsive to the interlocking rod, and the mounting portion comprising a retaining wall, a pair of hooks and a positioning slot, and the retaining wall is configured to be corresponsive to an end of the interlocking rod, and the pair of hooks are disposed on both sides of the retaining wall respectively, and the positioning slot is disposed on the other side of the retaining wall, and during installation, an end of the interlocking rod is abutted against the retaining wall, and then the interlocking rod is squeezed between the pair of hooks, so that the interlocking rod is latched among the retaining wall, the pair of hooks and the positioning slot;

wherein the retaining wall has a guiding block formed thereon and configured to be corresponsive to an end of the interlocking rod.

2. The interlocking slide rail set combined with a front cabinet lock as claimed in claim 1, wherein each of the interlocking sliders has an actuating portion configured to be corresponsive to the inner rail and the middle rail, and the inner rail has a first guiding portion at a front end thereof, and the middle rail has a second guiding portion at a front end thereof.

3. The interlocking slide rail set combined with a front cabinet lock as claimed in claim 2, wherein the first guiding portion is formed by bending both side edges of the inner rail obliquely and inwardly, and the second guiding portion is formed by bending both side edges of the middle rail obliquely and inwardly.

4. The interlocking slide rail set combined with a front cabinet lock as claimed in claim 1, wherein the retaining wall and the actuating portion have a sliding slot formed therebetween and configured to be corresponsive to the limiting hole for movably passing into the limiting hole.

5. The interlocking slide rail set combined with a front cabinet lock as claimed in claim 4, wherein both side edges of the inner rail have a pair of engaging slots configured to be corresponsive to a rear side of the first guiding portion for latching and positioning the second guiding portion of the middle rail.

6. The interlocking slide rail set combined with a front cabinet lock as claimed in claim 5, wherein the stopping portion has a limiting slot formed on a side relative to the two interlocking sliders, and the two interlocking sliders have a limiting boss corresponding to each other, so that after the stopper is installed, the two limiting bosses are pressed into the limiting slot to maintain a limit sliding state.

7. The interlocking slide rail set combined with a front cabinet lock as claimed in claim 5, further comprising a link rod sleeve and a link rod holder, and the link rod sleeve being installed to an end of uppermost the interlocking rod, and the link rod holder being installed into the cabinet and adjacent to the cabinet lock, so that the link rod sleeve is movably wrapped into the link rod holder, and the top of the link rod sleeve is configured to be corresponsive to the driving portion, and after the cabinet lock is turned, the driving portion presses the link rod sleeve to lock the interlocking slide rails.

* * * * *